United States Patent [19]

Dunn et al.

[11] 4,438,715

[45] Mar. 27, 1984

[54] BUTTONHOLE SEWING REPAIR

[75] Inventors: William H. Dunn, Branchville; William J. Edwards, Cranbury; Philip F. Minalga, Piscataway, all of N.J.

[73] Assignee: The Singer Company, Stamford, Conn.

[21] Appl. No.: 207,538

[22] Filed: Nov. 17, 1980

[51] Int. Cl.[3] ..... D05B 3/06; D05B 3/02

[52] U.S. Cl. ..... 112/158 B

[58] Field of Search ..... 112/264.1, 158 B, 121.12, 112/221

[56] References Cited

U.S. PATENT DOCUMENTS

| | | | |
|---|---|---|---|
| 3,872,809 | 3/1975 | Adams et al. | 112/221 |
| 4,000,706 | 1/1977 | Kneissl et al. | 112/221 |
| 4,135,459 | 1/1979 | Manabe et al. | 112/121.12 |
| 4,161,150 | 7/1979 | Brown | 112/158 B |

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

For a family sewing machine having the capabilities to complete a buttonhole in a single step, an arrangement is provided to permit an operator to reinitiate the buttonhole operation in the event of a thread breakage in the middle of the buttonhole, however, without necessitating stitching during that part of the buttonhole in which stitching has already been implemented. If a thread breakage takes place and after repair thereof the buttonhole may be repositioned to the initiating position and the buttonhole pattern may be reselected together with, for example, a selection of reverse feeding or any other input which is not normally selected during buttonholing. This dual selection is effective to signal the needle bar release logic to suspend endwise reciprocation of the needle bar. The sewing machine feed proceeds as though stitching were taking place, and just before the point of thread breakage is reached the needle bar release logic can be defeated so that stitching may proceed from a point one or two stitches prior to the point of breakage.

5 Claims, 4 Drawing Figures

BUTTONHOLE SEWING REPAIR

DESCRIPTION

BACKGROUND OF THE INVENTION

This invention is in the field of sewing machines; more particularly, it is concerned with family sewing machines having a buttonholing capability.

It is well known in the prior art to have family sewing machines having the capability for stitching a complete buttonhole in a single step by utilizing a sliding presser foot which travels with the work material and actuates mechanical or electronic means to implement the turn around at the end of the buttonhole. Such a sewing machine is disclosed in U.S. Pat. No. 4,159,685 of Wurst et al. In this patent an electronically controlled sewing machine is disclosed having the capability to alter the width of the cutting space in the central portion of the buttonhole in order to accommodate, for example, various thickness buttons. An additional problem encountered with generating a buttonhole is that it is not possible to start anywhere on the buttonhole, but only at the beginning of the pattern. If an upper or lower thread breaks or the lower thread supply is depleted, generally the material must be removed from the sewing machine and the stitching already accomplished must be removed from the work material. Thereafter, a new buttonhole may be initiated.

What is required is the capability, in a family sewing machine, for accommodating to an event such as thread breakage or depletion in the middle of a buttonhole without the necessity for thread removal or the unsightly appearance of double stitching on a portion of the buttonhole.

SUMMARY OF THE INVENTION

Such a requirement can be obtained in an electronically controlled sewing machine having a needle bar release device for skipping stitches, by reinitiating the buttonhole and omitting those stitches already performed, implementing stitching only to obtain a small overlap of one or two stitches. In an electronically controlled sewing machine such as is described in the above noted patent the reverse input selection button is not used when the buttonhole is sewn. By combining the selection of the buttonhole pattern with that of the reverse input the sewing machine logic may be signaled that a buttonhole repair is taking place and that the needle bar release must be implemented until such time as the reverse input selection is defeated.

In application, selection of a small or large buttonhole is determined by way of an OR gate which provides an input, together with a reverse input selection, to an AND gate. The AND gate outputs to a D latch which is clocked by a feed synchronizing signal to input to a second OR gate so as to enable a needle bar release drive logic to implement needle bar release.

If thread breakage occurs during stitching of a buttonhole, the sewing machine may be stopped, the thread condition rectified and the work material repositioned to the buttonhole initiating position. Thereupon, selection is made of the buttonhole and reverse feed input, which, as explained above, will suspend needle bar reciprocation while feeding the work material according to instructions from the pattern ROM for buttonhole. One or two stitches before the termination of the incompleted buttonhole is reached the reverse feed input may be activated once again to defeat this input and to reengage the needle bar latch to continue endwise reciprocation thereof. The remainder of the buttonhole proceeds in the normal fashion.

DESCRIPTION OF THE DRAWINGS

The invention accordingly comprises the constructions hereinafter described, the scope of the invention being indicated in the following claims. In the accompanying drawings:

DETAILED DESCRIPTION

Figure 1:
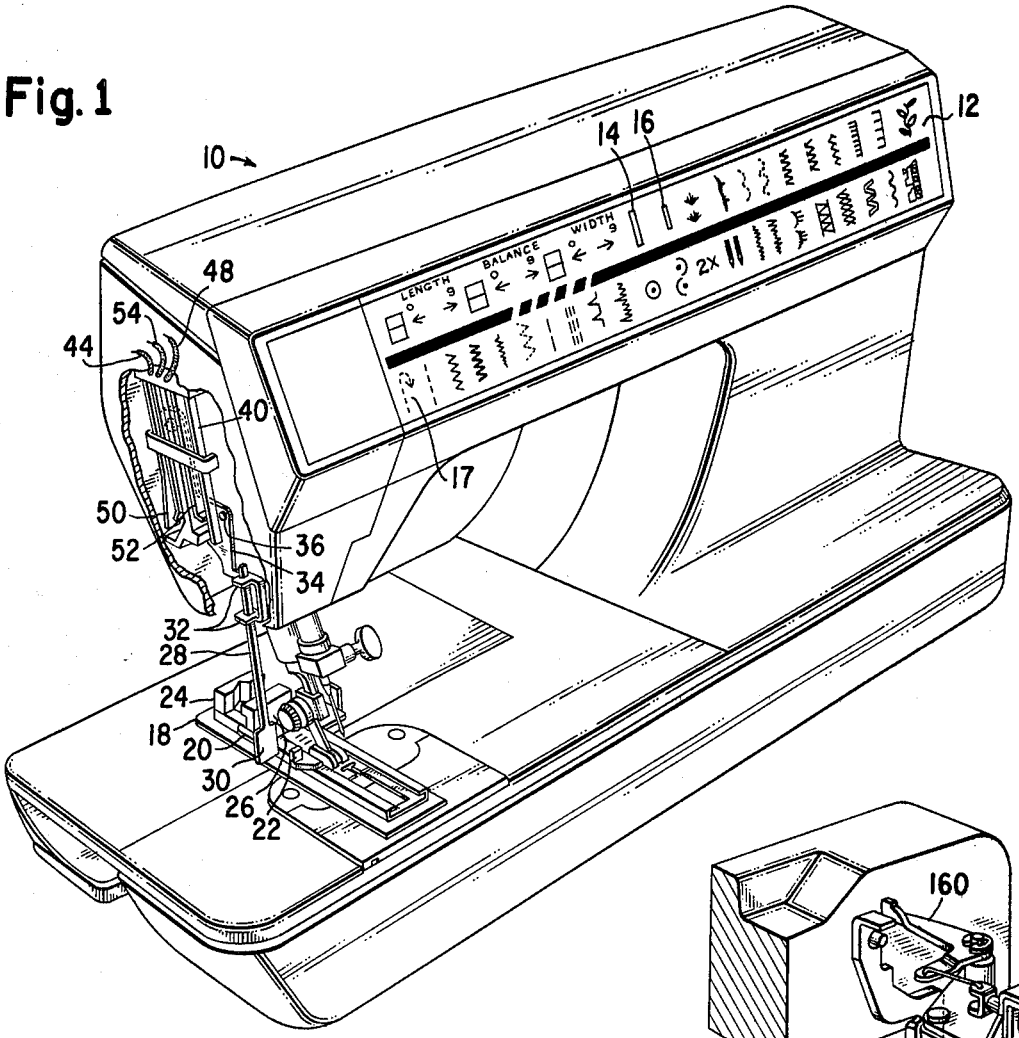
FIG. 1 is a perspective view of a sewing machine in which an arrangement constructed in accordance with the principals of this invention may be incorporated.

Referring to the drawings, FIG. 1 illustrates a sewing machine indicated generally at 10 having a control panel 12 illustratively of the type utilizing a continuous planar element such as a glass panel to which circuitry is applied as by deposition or the like to provide controls sensitive to the touch of an operator's finger. Indicated on the control panel 12 are touch sensitive areas having respective representations of various stitch patterns which may be automatically sewn by the sewing machine 10. For an understanding of the manner in which automatic pattern sewing may be accomplished, the reader is referred to U.S. Pat. No. 3,872,808, issued to John W. Wurst on March 25, 1975, the disclosure of which is hereby incorporated by reference herein.

The subject invention is concerned with the sewing of a buttonhole pattern. The sewing machine 10 is provided with a capability of sewing either a large buttonhole indicated by the large buttonhole representation 14 on the control panel 12, or a small buttonhole, indicated by the small buttonhole representation 16 on the control panel.

Also apparent is an insignia for the reverse feed input 17 implemented by an arrow curved downwardly. When a buttonhole pattern is to be sewn, a buttonhole presser foot 18 is installed on the sewing machine 10. The buttonhole presser foot 18 is of the type described in U.S. Pat. No. 3,877,403, which issued to S. J. Ketterer on April 15, 1975. The buttonhole presser foot 18 includes a fixed rear stop member 20 and an adjustable front stop member 22, the distance therebetween defining the length of the buttonhole pattern being sewn, as determined by the size of the button inserted between an anchor element 24 and a button gauging element 26. The sewing machine 10 further includes a switch mechanism including a lever arm 28 terminating in a paddle 30 at its lower end. The other end of the lever arm 28 is received by openings in a pair of spaced lugs 32 formed at one end of a lever 34. The lever arm 28 may therefore be selectively raised and lowered by an operator, the operator lowering the lever arm 28 so that the paddle 30 is intermediate the stops 20 and 22 during the formation of a buttonhole pattern.

The lever 34 is pivoted at 36 for cooperation with an electrical switch member 40. The switch member 40 outputs data on wires 44, 48, 54 to the sewing machine electronics according to the position of the buttonhole foot 18 as sensed by the paddle 30. A complete description of the operation of this buttonhole presser foot 18 in an electronically controlled sewing machine may be had by reference to the U.S. Pat. No. 4,159,685 of Wurst et al. which issued on July 3, 1979 to the assignee of the instant invention and is hereby incorporated by reference herein.

Figure 2:
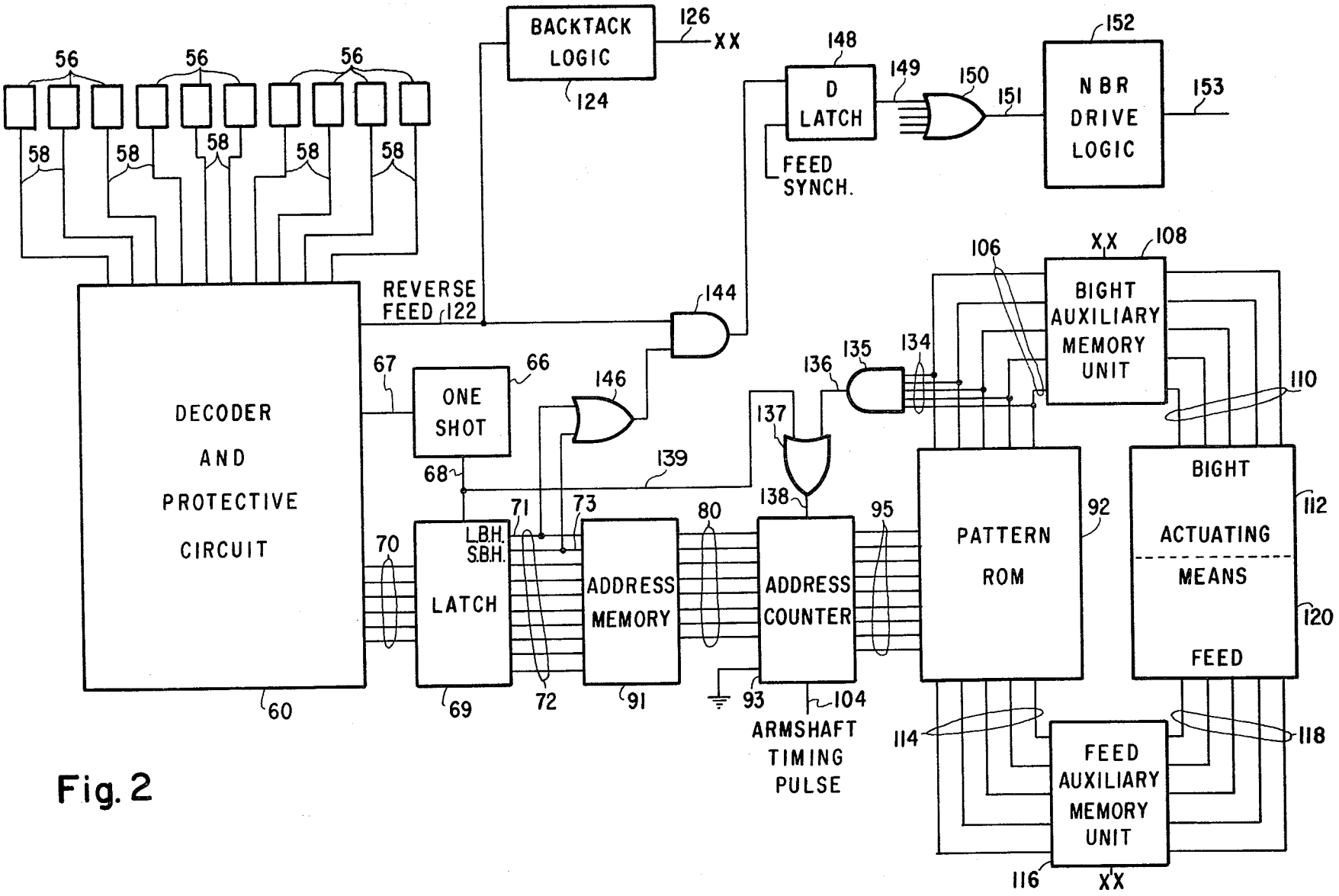
FIG. 2 is a schematic diagram of the logic circuitry showing a sewing machine ornamental stitch pattern signal generating system operative in response to electronic pattern selection signals in which the buttonhole repair arrangement of this invention has been applied.

Referring now to FIG. 2 there is shown the functional block diagram of the sewing machine incorporating the buttonhole repair device. Ten groups of touch pads 56 are provided any two of which may be activated to implement a pattern selection. By utilizing this technique there are 45 unique combinations of pairs which far exceeds the selection potential possible where one touch pad accomplishes one selection. The touch pads are connected by wires 58 to a decoder and protective circuit 60 which interprets the pair selection and insures that a deliberate touch was made. The decoder and protective circuit 60 outputs via lead 67 to a one shot multi vibrator 66 and the output of the one shot is connected via a lead 68 to a latch 69. The latch 69 is also connected to the decoder and protective circuit 60 by leads 70. A pulse appearing on line 68 from the one shot 66 will cause the signal appearing on line 70 to provide a continuous output from the latch on output lines 72. The output from the latch 69 includes as is shown a selection for a large buttonhole on line 71 and a small buttonhole on line 73. Thus, a pattern selector code word appearing on line 73 is coupled to the address memory 91 which provides on output lines 80 a code word representing the pattern selected. This code word is applied to address counter 93 as the starting point of the counter. The address counter 93 has a counter input line 104 which provides pulses from an arm shaft pulse generator. Output lines 95 are connected to the inputs of the pattern read only memory (ROM) 92. The ROM 92 provides on output lines 106 an input to an auxiliary memory unit 108. From the auxiliary memory unit 108, output lines 110 provide the digital code word for the bight actuating means 112. Similarly lines 114 output from the pattern ROM 92 to the auxiliary memory unit 116 which auxiliary memory unit provides via lines 118 a digital code word to the feed actuating means 120.

Additionally included in the pattern ROM 92 is an end indicating word which denotes the end of each selected pattern. For example, if an end code word was chosen to be 11111, lines 134 from the lines 106 to an AND gate 135 will cause the AND gate to output to an OR gate 137. The OR gate also has as input thereto the output from the one shot 66, by way of line 139. The output of the OR gate 137 is connected to the reset input of address counter 93, via line 138. Thus, the address counter will be reset each time the end code word is generated by the pattern ROM. The additional input to OR gate 137 from the output of one shot 66 provide for resetting the address counter 93 each time any ornamental stitch pattern or straight stitch is selected by the operator. Further particulars on the above arrangement may be had by reference to U.S. Pat. No. 3,872,808.

Actuation of the reverse feed input 17 on the control panel 12 shown in FIG. 1 will result in an output from the decoder and protective circuit 60 on line 122 to a back tack logic 124. Particulars on this back tack logic may be obtained from U.S. Pat. No. 4,147,119, issued on April 3, 1979 to Dunn, which is hereby incorporated by reference herein. Briefly, selection of the reverse feed input 17 actuates touch pads 56 from two separate groups which are decoded in the decoder to provide a signal to implement reverse feed. According to the teachings of the above patent, if the reverse feed is implemented while the sewing machine is operating, the reverse feed is effective only so long as the reverse feed input 17 is activated. However, if the reverse feed input 17 were to be activated when the sewing machine was not operating, the reverse feed would be latched in so as to be effective until the reverse feed input is reactivated by an operator. The output from back tack logic 124 is by way of line 126 which is marked with an XX. It will be observed that one input to the bight auxiliary memory unit 108 and the feed auxiliary memory unit 116 is an XX from the back tack logic 124 which, for example, on reverse feed selection would cause the sewing needle to go to center position while feeding the work material at a specific rate in a reverse direction.

The reverse feed signal on line 122 will also pass to an AND gate 144. A second of the two possible inputs to the AND gate 144 will be derived from an OR gate 146 which has as possible inputs thereto the large buttonhole and small buttonhole signals put out by the latch 69 to the address memory 91. Thus, if the large buttonhole input 14 or small buttonhole input 16 has been selected and the reverse feed input 17 has been actuated, the AND 144 will output a signal to a D latch 148, which latch is clocked by a feed synchronization signal to provide an output to an OR gate 150. Thus, if a buttonhole input 14, 16 has been selected and the reverse feed input 17 has also been activated, the AND gate 144 outputs a high to the D latch 148 which latch releases the information to the output line 149 thereof when clocked by the signal to release feed information to the feed actuating means 120, for a reason to be explained below. The output from the D latch passes on to the OR gate 150 which OR gate enables a needle bar release drive logic 152 on its output line 151, thereby causing the needle bar release logic to output a release signal on line 153.

Figure 3:
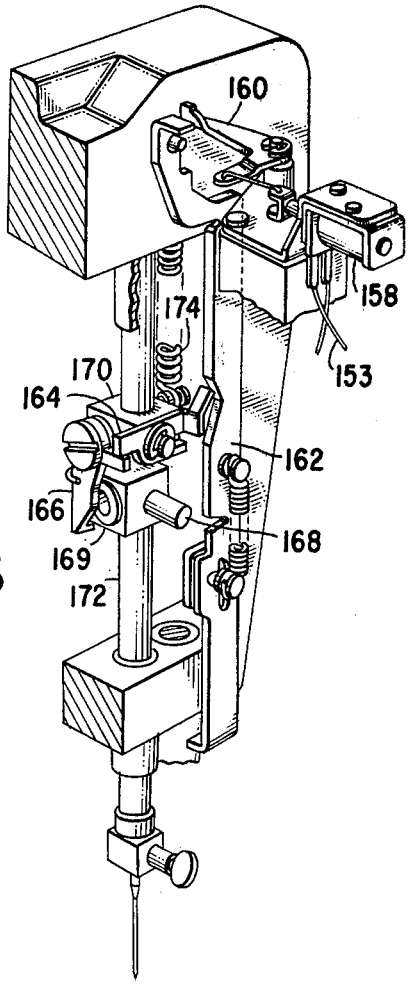
FIG. 3 is a perspective view of a needle bar release device utilized in the present invention.

Referring now to FIG. 3 there is shown a needle bar latching mechanism which is preferrably of the kind shown and described in U.S. Pat. No. 3,872,809 which is incorporated herein by reference. Such needle latching mechanism includes a solenoid 158 which in response to a signal from the needle bar release drive logic 152 by way of line 53, shifts mechanical linkages including a bell crank 160, an elongated latch release member 162 and pivoted latch members 164, 166 to uncouple a needle bar reciprocating block 169 from a collar 170 which is fixed to the needle bar 172. A spring 174 causes the needle bar 172 to rise to the top of its stroke when block 169 and collar 170 are uncoupled and the needle bar remains in such position until another signal is fed to solenoid 158. Solenoid 158 responds to this latter signal by shifting the said linkages including bell crank 160, latch release member 162 and latch members 164, 166 in a manner causing needle bar reciprocating block 168 to be coupled to collar 170 on the needle bar 172 and the needle bar to be reciprocated by drive linkage (not shown) connected to the block 169 through shaft 168. The relatively high inertia of this mechanical unlatching system is compensated for by utilizing the feed timing signal (feed synchronization) to signal information transfer to NBR drive logic 152. The needle bar release information is thus obtained at a time when the sewing needle is in a work material and becomes effective when the needle is at the top of its stroke.

Figure 4A:
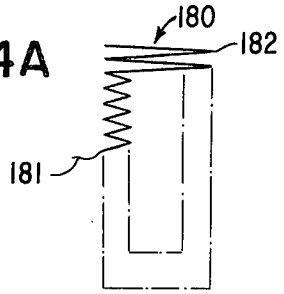
FIG. 4 (*a*) is a representation of an incomplete buttonhole due to thread breakage, and (*b*) is a representation of the buttonhole of 4*a* completed as taught by the invention.
Figure 4B:
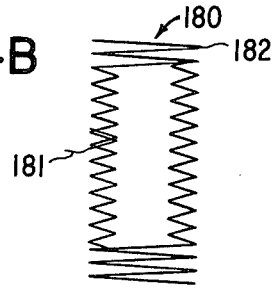

Thus has been disclosed a system which responds to selection of a buttonhole, and another input unique for buttonhole, to inhibit stitching while permitting feed to take place. This system can be used to rectify a buttonhole 180 (FIG. 4*a*) which is incomplete due to a disturbance in the thread supply. Thus as an interruption takes place due to, for example, a thread breakage 181, the thread breakage may be repaired and the work material may be repositioned at the start or initiating position 182 for the buttonhole 180. Thereafter, the appropriate large or small buttonhole input 14, 16 and reverse feed input 17 may be selected in any order and the sewing machine may be actuated by depression of the usual foot treadle. As explained above selection of the reverse feed input 17 while the sewing machine is not being operated will latch in the reverse feed input. To reinitiate forward feed or normal operation would require a second selection of the reverse feed input 17. Selection of both the large or small buttonhole input 14, 16 and of a second input such as the reverse feed input 17 not normally used during buttonholing, signals the sewing machine logic that reciprocation of the needle bar 172 should be suspended until such time as the reverse feed input is defeated. Therefore, prior to defeat of the reverse feed input 17, the work material is fed and needle bar reciprocation is suspended. The reverse feed input 17 may be defeated at a point 183 one or two stitches before where the thread breakage or other event causing the incomplete buttonhole took place. Thus the remaining portion of the buttonhole may be stitched and only some thread trimming at the overlap point 183 would be required to attain the appearance of an uninterrupted buttonhole.

It is understood that various changes in and modifications of the embodiment of the invention illustrated and described herein may be made without departing from the spirit and scope of the invention, and the annexed claims are intended to cover all such variations. It is important to emphasize that the use of reverse is only because it is available. The intent of the disclosure is to use any available signal not normally used in order not to add more controls. With the buttonhole selection, almost any other pattern or control selection would work equally well, requiring some means in the sewing machine logic for recognition of that specific selection.

We claim:

1. A method for repairing an incomplete buttonhole in a work material on a sewing machine having a needle bar, a feed system, actuating means for reciprocating said needle bar and actuating said feed system, means for selectively suspending needle bar reciprocation, and means for implementing a buttonhole from an initiating position, said method comprising the steps of:

a. repositioning said work material at the initiating position for said incomplete buttonhole;

b. activating said means for suspending needle bar reciprocation and said means for implementing a buttonhole;

c. actuating said actuating means for actuating said feed system while suspending needle bar reciprocation during that portion of said incomplete buttonhole already stitched;

d. reinitiating needle bar reciprocation substantially at the point where said buttonhole is incomplete.

2. A method for repairing an incomplete buttonhole in a work material on a sewing machine having a needle bar, a feed system, actuating means for reciprocating said needle bar and actuating said feed system, means for selectively suspending needle bar reciprocation, means for implementing a buttonhole from an initiating position, means for selecting the operation to be performed by the sewing machine including a buttonhole pattern and at least one other operation not relevant to the buttonhole selection, and means responsive to selection of said buttonhole pattern and said at least one other operation for actuating said suspending means for needle bar reciprocation while implementing the feeding steps of said buttonhole pattern, said method comprising the steps of:

a. repositioning said work material at the initiating position for said incomplete buttonhole;

b. selecting said buttonhole pattern and said at least one other operation not relevant to said buttonhole selection;

c. actuating said actuating means for implementing a buttonhole while said means for suspending needle bar reciprocation is activated; and, d. reinitiating needle bar reciprocation substantially at the point where said buttonhole is incomplete.

3. A sewing machine having a needle bar, a feed system, actuating means for reciprocating said needle bar and actuating said feed system, means for selectively suspending needle bar reciprocation, means for implementing a buttonhole from an initiating position, means for selecting the operation to be performed by the sewing machine including a buttonhole pattern and at least one other operation not relevant to the buttonhole selection, the improvement comprising:

means responsive to selection of said buttonhole pattern and said at least one other operation for actuating said suspending means and said implementing means thereby to suspend needle bar reciprocation while feeding a work material in accordance with said buttonhole pattern; and, means for defeating said suspending means to reinitiate stitching with feed of a work material.

4. An electronically controlled sewing machine having a needle bar, a gate supporting said needle bar for endwise reciprocation and lateral oscillation, a feed system for feeding a work material through said sewing machine, actuating means for reciprocating said needle bar and actuating said feeding system, means responsive to electronic signals for selectively suspending needle bar reciprocation, means for implementing a buttonhole from an initiating position, pattern memory means, means for selecting the operation to be performed by the sewing machine including a buttonhole pattern and at least one other operation not relevant to the buttonhole selection, the improvement comprising:

means responsive to selection of said buttonhole pattern and said at least one other operation for actuating said suspending means and said implementing means thereby to suspend needle bar reciprocation while feeding a work material in accordance with said buttonhole pattern; and, means for defeating said suspending means to reinitiate stitching with feeding of a work material.

5. A sewing machine as claimed in claim 4 wherein said feed system includes a feed regulator and a regulator actuator for selectively varying the feeding rate and direction, and wherein said selecting means includes means for selecting reverse feeding of said feed system, said sewing machine further including means for selecting a latching operation of said reverse feed and for defeating a latching operation of said reverse feed, wherein said actuating means is responsive to selection of buttonhole pattern and said reverse feed in the latching mode for suspending needle bar reciprocation, and wherein said defeating means is implemented by defeating said latching mode of said reverse feed.

* * * * *